US008490690B2

(12) United States Patent
Lopez

(10) Patent No.: US 8,490,690 B2
(45) Date of Patent: Jul. 23, 2013

(54) SELECTIVE CONTROL OF FLOW THROUGH A WELL SCREEN

(75) Inventor: Jean-Marc Lopez, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 325 days.

(21) Appl. No.: 12/887,375

(22) Filed: Sep. 21, 2010

(65) Prior Publication Data

US 2012/0067574 A1 Mar. 22, 2012

(51) Int. Cl.
*E21B 43/00* (2006.01)

(52) U.S. Cl.
USPC ..... 166/205; 166/376

(58) Field of Classification Search
USPC ..... 166/227–236, 157, 205, 376, 164
See application file for complete search history.

(56) References Cited

U.S. PATENT DOCUMENTS

| | | | | |
|---|---|---|---|---|
| 3,273,641 | A | 9/1966 | Bourne | |
| 4,157,732 | A | 6/1979 | Fonner | |
| 5,048,334 | A | 9/1991 | Hampton et al. | |
| 5,355,956 | A | 10/1994 | Restarick | |
| 5,662,211 | A | 9/1997 | Quentin | |
| 6,092,604 | A | 7/2000 | Rice et al. | |
| 6,719,051 | B2 | 4/2004 | Hailey, Jr. et al. | |
| 6,857,476 | B2 | 2/2005 | Richards | |
| 7,699,101 | B2 | 4/2010 | Fripp et al. | |
| 2002/0142919 | A1* | 10/2002 | Constien | 507/100 |
| 2005/0155772 | A1 | 7/2005 | Dusterhoft et al. | |
| 2005/0274522 | A1* | 12/2005 | Surjaatmadja et al. | 166/308.1 |
| 2006/0113077 | A1 | 6/2006 | Willberg et al. | |
| 2007/0039741 | A1* | 2/2007 | Hailey | 166/376 |
| 2009/0283271 | A1 | 11/2009 | Langeslag | |

OTHER PUBLICATIONS

International Search Report with Written Opinion issued Feb. 9, 2012 for PCT Patent Application No. PCT/US11/050750, 9 pages.
International Fishing Devices, Inc., "Commercial Applications," dated 2005.
International Fishing Devices, Inc., "Galvanic Underwater Releases," dated 2005.
Office Action issued Feb. 12, 2009, for U.S. Appl. No. 11/635,159, 8 pages.
Office Action issued Jul. 9, 2009, for U.S. Appl. No. 11/635,159, 6 pages.
Halliburton, Reliable Zonal Isolation; H05794; dated 2009; 6 pages.
Halliburton, What is Reliability Worth?, dated 2009, 1 page.
Halliburton, Cable System Has Self-Healing Properties, Apr. 2008, 1 page.

* cited by examiner

*Primary Examiner* — William P Neuder
*Assistant Examiner* — Kipp Wallace
(74) *Attorney, Agent, or Firm* — Smith IP Services, P.C.

(57) ABSTRACT

A method of selectively controlling flow through a well screen can include installing the well screen in a wellbore, and then exposing the well screen to an aqueous fluid, thereby permitting flow through the well screen. A well screen assembly can include a well screen and an acid containing structure which dissolves in response to contact with an aqueous fluid, whereby flow through the well screen is selectively permitted.

15 Claims, 4 Drawing Sheets

SELECTIVE CONTROL OF FLOW THROUGH A WELL SCREEN

BACKGROUND

This disclosure relates generally to equipment utilized and services performed in conjunction with a subterranean well and, in an example described below, more particularly provides for selective control of flow through a well screen.

It can be advantageous to be able to selectively control flow through a well screen. In the past, aluminum plugs have been installed in a well screen base pipe, in order to block flow through the well screen until the aluminum plugs are dissolved. Unfortunately, a large volume of acid had to be circulated from the earth's surface down to the well screen, in order to initiate dissolving of the plugs. This method was inefficient, costly and time-consuming.

Therefore, it will be appreciated that improvements are needed in the art of selectively controlling flow through well screens.

SUMMARY

In the disclosure below, a well system and associated method are provided which bring improvements to the art of controlling flow through well screens. One example is described below in which acid is selectively released from an acid containing structure in a well screen assembly. Another example is described below in which water or another aqueous fluid is flowed into contact with a well screen assembly, in order to permit flow through a sidewall of a well screen.

In one aspect, the present disclosure provides to the art a method of selectively controlling flow through a well screen. The method can include installing the well screen in a wellbore, and then exposing the well screen to an aqueous fluid, thereby permitting flow through the well screen.

In another aspect, a well screen assembly for use in a subterranean well is provided by this disclosure. The well screen assembly can include a well screen and an acid containing structure which at least partially dissolves in response to contact with an aqueous fluid, whereby flow through the well screen is selectively permitted.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
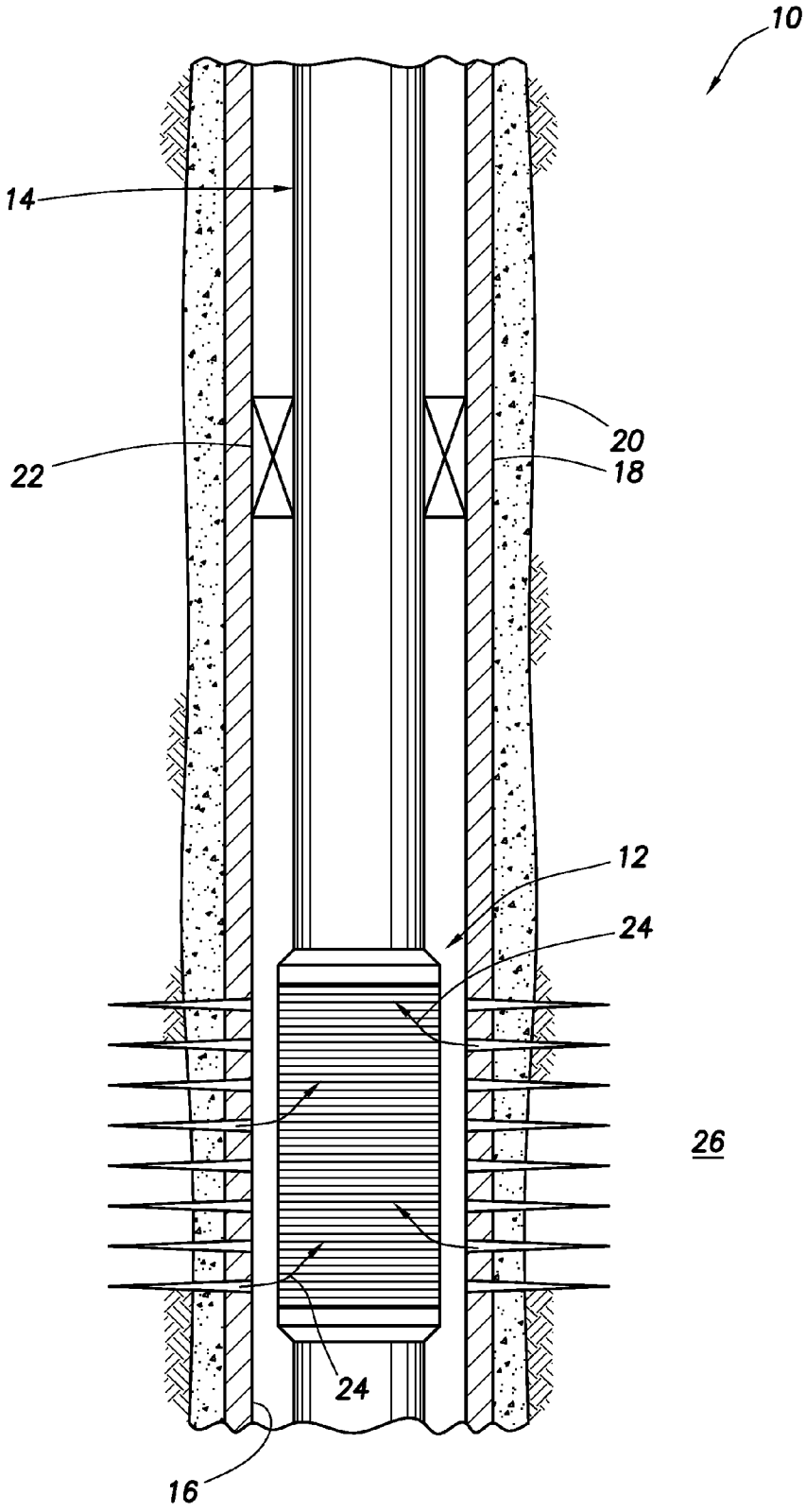
FIG. 1 is a schematic partially cross-sectional view of a well system and associated method which can embody principles of the present disclosure.

Representatively illustrated in FIG. 1 is a well system 10 and associated method which can embody principles of this disclosure. In the example depicted in FIG. 1, a well screen assembly 12 has been interconnected in a tubular string 14 (such as a production tubing string), and has been installed in a wellbore 16. The wellbore 16 is illustrated as being lined with casing 18 and cement 20, but in other examples the wellbore could be uncased or open hole in a zone surrounding the well screen assembly 12.

It is many times advantageous to circulate fluid through the tubular string 14 during installation. It can also be advantageous to be able to internally pressurize the tubular string 14 upon installation (for example, to set a packer 22).

For these reasons and others, it can be beneficial to be able to prevent fluid flow through a sidewall of the well screen assembly 12 during installation, and later selectively permit flow through the sidewall. When flow is permitted through the sidewall of the well screen assembly 12, a fluid portion of a gravel packing slurry can enter the assembly, fluid 24 can be produced from an earth formation 26 surrounding the wellbore 16, etc.

At this point, it should be pointed out that the well system 10 illustrated in FIG. 1 and described herein is provided as merely one example of a wide variety of well systems which can embody the principles of this disclosure. Therefore, it should be clearly understood that the principles of this disclosure are not limited at all to any of the details of the well system 10.

Figure 2:
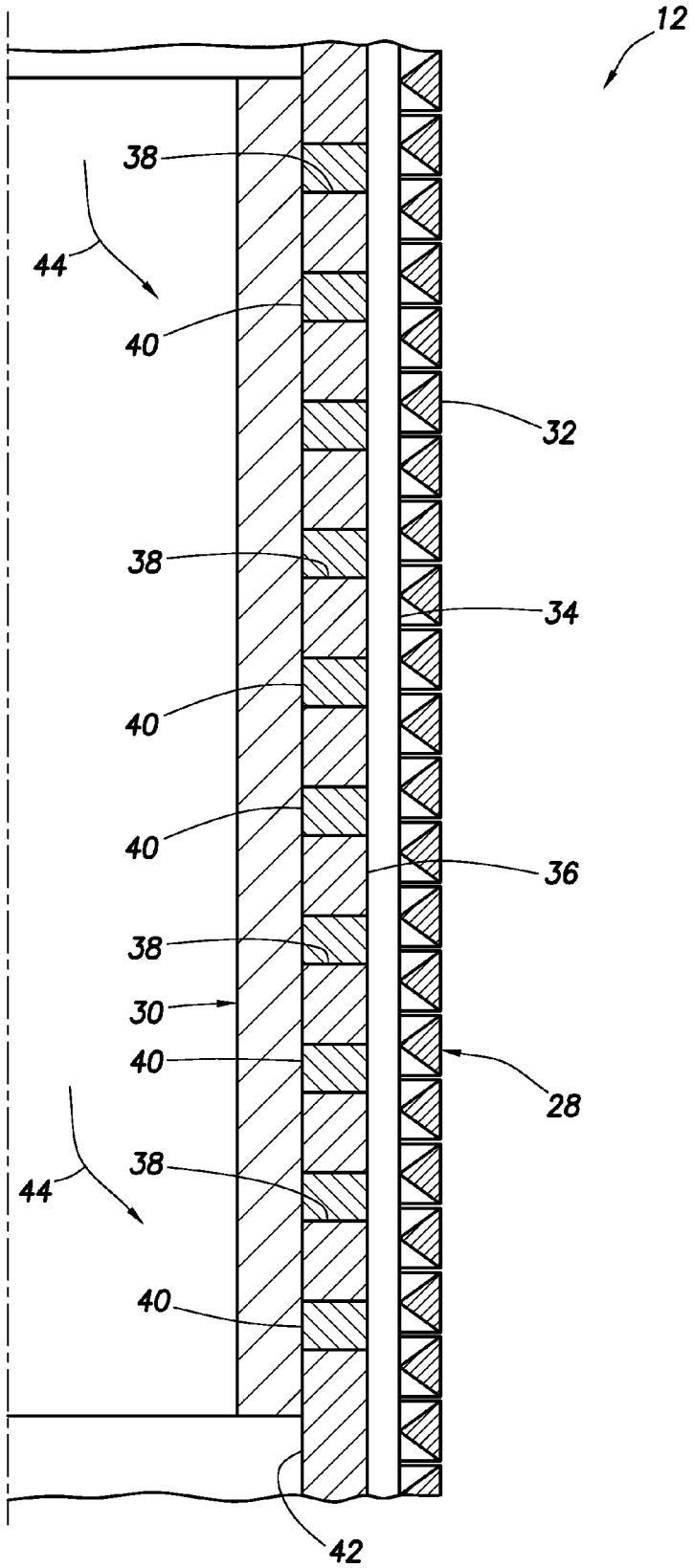
FIG. 2 is an enlarged scale schematic cross-sectional view of a well screen assembly which may be used in the well system and method of FIG. 1.

Referring additionally now to FIG. 2, an enlarged scale cross-sectional view of the well screen assembly 12 is representatively illustrated. The assembly 12 is depicted in FIG. 2 as including a well screen 28 and an acid containing structure 30.

The well screen 28 includes a filter portion 32 of the wire-wrapped type. However, any type of filter portion (such as, wire mesh, sintered, pre-packed, etc.) may be used, as appropriate for a particular application.

The well screen 28 also includes a drainage layer 34 comprising multiple longitudinally extending rods. However, any type of drainage layer may be used, as desired.

The filter portion 32 and drainage layer 34 are positioned on a generally tubular base pipe 36 having openings 38 in a sidewall thereof. The openings 38 are blocked by plugs 40 which, in this example, are preferably made of an aluminum material, although other materials may be used, if desired.

The plugs 40 block flow through a sidewall of the well screen 28. However, the plugs 40 can be selectively dissolved, when desired, by releasing an acid from the acid containing structure 30.

In the example of FIG. 2, the acid containing structure 30 is in the form of a generally tubular sleeve positioned in a flow passage 42 extending longitudinally through the base pipe 36. When interconnected in the tubular string 14 in the well system 10, the flow passage 42 extends through the tubular string for production of the fluid 24 to the surface.

The acid containing structure 30 depicted in FIG. 2 is made of a polylactic acid material which releases acid when the material dissolves in response to contact with water or another aqueous fluid 44. The released acid, in turn, dissolves the plugs 40, thereby permitting flow of the fluid 24 through the sidewall of the well screen 28.

Thus, flow through the sidewall of the well screen 28 can be selectively permitted by merely contacting the structure 30 with an aqueous fluid 44. The fluid 44 can be conveniently flowed through the tubular string 14 to the well screen assembly 12, or otherwise brought into contact with the structure 30 (for example, the fluid 24 produced from the formation 26 could comprise an aqueous fluid) from an interior and/or an exterior of the well screen 28.

Note that there is no need to circulate a volume of acid from the surface and through the tubular string 14 to the well screen 28. Instead, the acid is already present at the well screen 28 when it is installed in the wellbore 16. Thus, safety, convenience and efficiency are all enhanced by use of the well screen assembly 12.

Figure 3:
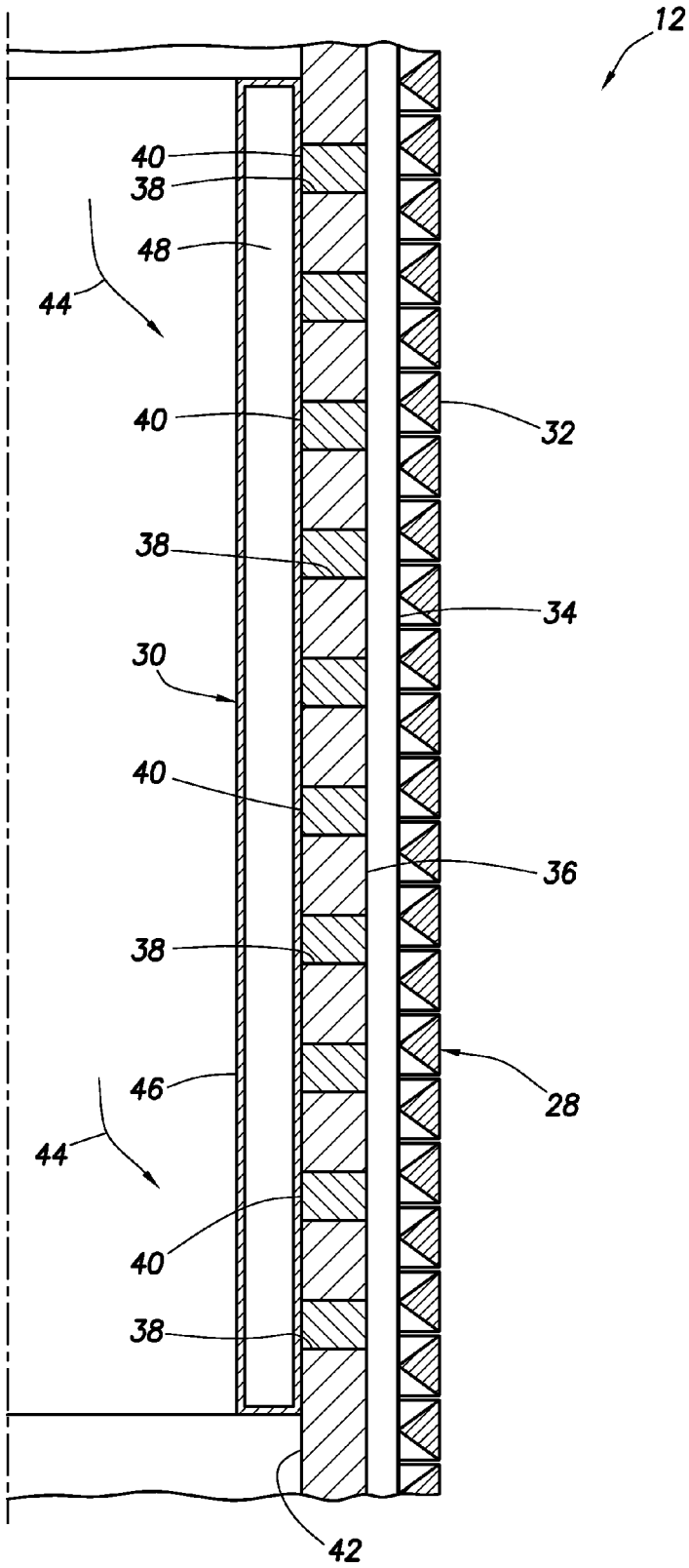
FIG. 3 is a schematic cross-sectional view of another configuration of the well screen assembly.

Referring additionally now to FIG. 3, another configuration of the well screen assembly 12 is representatively illustrated. The configuration of FIG. 3 is similar in many respects to the configuration of FIG. 2, but differs in at least one significant respect, in that the acid containing structure 30 of FIG. 3 comprises a container 46 which contains an acid 48 therein.

The container 46 could be made of a polylactic acid material, or another material which is dissolvable in response to contact with the aqueous fluid 44. The acid 48 could be hydrochloric acid, sulfuric acid or any other acid which is capable of dissolving the plugs 40.

Other suitable degradable materials for the container 46 include hydrolytically degradable materials, such as hydrolytically degradable monomers, oligomers and polymers, and/or mixtures of these. Other suitable hydrolytically degradable materials include insoluble esters that are not polymerizable. Such esters include formates, acetates, benzoate esters, phthalate esters, and the like. Blends of any of these also may be suitable.

For instance, polymer/polymer blends or monomer/polymer blends may be suitable. Such blends may be useful to affect the intrinsic degradation rate of the hydrolytically degradable material. These suitable hydrolytically degradable materials also may be blended with suitable fillers (e.g., particulate or fibrous fillers to increase modulus), if desired.

The choice of hydrolytically degradable material also can depend, at least in part, on the conditions of the well, e.g., well bore temperature. For instance, lactides may be suitable for use in lower temperature wells, including those within the range of 15 to 65 degrees Celsius, and polylactides may be suitable for use in well bore temperatures above this range.

The degradability of a polymer depends at least in part on its backbone structure. The rates at which such polymers degrade are dependent on the type of repetitive unit, composition, sequence, length, molecular geometry, molecular weight, morphology (e.g., crystallinity, size of spherulites and orientation), hydrophilicity, hydrophobicity, surface area and additives. Also, the environment to which the polymer is subjected may affect how it degrades, e.g., temperature, amount of water, oxygen, microorganisms, enzymes, pH and the like.

Some suitable hydrolytically degradable monomers include lactide, lactones, glycolides, anhydrides and lactams.

Some suitable examples of hydrolytically degradable polymers that may be used include, but are not limited to, those described in the publication of Advances in Polymer Science, Vol. 157 entitled "Degradable Aliphatic Polyesters" edited by A. C. Albertsson. Specific examples include homopolymers, random, block, graft, and star- and hyper-branched aliphatic polyesters.

Such suitable polymers may be prepared by polycondensation reactions, ring-opening polymerizations, free radical polymerizations, anionic polymerizations, carbocationic polymerizations, and coordinative ring-opening polymerization for, e.g., lactones, and any other suitable process. Specific examples of suitable polymers include polysaccharides such as dextran or cellulose; chitin; chitosan; proteins; aliphatic polyesters; poly(lactides); poly(glycolides); poly(ε-caprolactones); poly(hydroxybutyrates); aliphatic polycarbonates; poly(orthoesters); poly(amides); poly(urethanes); poly(hydroxy ester ethers); poly(anhydrides); aliphatic polycarbonates; poly(orthoesters); poly(amino acids); poly(ethylene oxide); and polyphosphazenes.

Of these suitable polymers, aliphatic polyesters and polyanhydrides may be preferred. Of the suitable aliphatic polyesters, poly(lactide) and poly(glycolide), or copolymers of lactide and glycolide, may be preferred.

The lactide monomer exists generally in three different forms: two stereoisomers L- and D-lactide and racemic D,L-lactide (meso-lactide). The chirality of lactide units provides a means to adjust, among other things, degradation rates, as well as physical and mechanical properties.

Poly(L-lactide), for instance, is a semi-crystalline polymer with a relatively slow hydrolysis rate. This could be desirable in applications where a slower degradation of the hydrolytically degradable material is desired.

Poly(D,L-lactide) may be a more amorphous polymer with a resultant faster hydrolysis rate. This may be suitable for other applications where a more rapid degradation may be appropriate.

The stereoisomers of lactic acid may be used individually or combined. Additionally, they may be copolymerized with, for example, glycolide or other monomers like ε-caprolactone, 1,5-dioxepan-2-one, trimethylene carbonate, or other suitable monomers to obtain polymers with different properties or degradation times. Additionally, the lactic acid stereoisomers can be modified by blending high and low molecular weight poly(lactide) or by blending poly(lactide) with other polyesters.

Plasticizers may be present in the hydrolytically degradable materials, if desired. Suitable plasticizers include, but are not limited to, derivatives of oligomeric lactic acid, polyethylene glycol; polyethylene oxide; oligomeric lactic acid; citrate esters (such as tributyl citrate oligomers, triethyl citrate, acetyltributyl citrate, acetyltriethyl citrate); glucose monoesters; partially fatty acid esters; PEG monolaurate; triacetin; poly(ε-caprolactone); poly(hydroxybutyrate); glycerin-1-benzoate-2,3-dilaurate; glycerin-2-benzoate-1,3-dilaurate; starch; bis(butyl diethylene glycol)adipate; ethylphthalylethyl glycolate; glycerine diacetate monocaprylate; diacetyl monoacyl glycerol; polypropylene glycol (and epoxy, derivatives thereof); poly(propylene glycol)dibenzoate, dipropylene glycol dibenzoate; glycerol; ethyl phthalyl ethyl glycolate; poly(ethylene adipate)distearate; di-iso-butyl adipate; and combinations thereof.

The physical properties of hydrolytically degradable polymers depend on several factors such as the composition of the repeat units, flexibility of the chain, presence of polar groups, molecular mass, degree of branching, crystallinity, orientation, etc. For example, short chain branches reduce the degree of crystallinity of polymers while long chain branches lower the melt viscosity and impart, among other things, elongational viscosity with tension-stiffening behavior.

The properties of the material utilized can be further tailored by blending, and copolymerizing it with another polymer, or by a change in the macromolecular architecture (e.g., hyper-branched polymers, star-shaped, or dendrimers, etc.). The properties of any such suitable degradable polymers (e.g., hydrophobicity, hydrophilicity, rate of degradation, etc.) can be tailored by introducing select functional groups along the polymer chains.

For example, poly(phenyllactide) will degrade at about ⅕th of the rate of racemic poly(lactide) at a pH of 7.4 at 55 degrees C. One of ordinary skill in the art with the benefit of this disclosure will be able to determine the appropriate functional groups to introduce to the polymer chains to achieve the desired physical properties of the degradable polymers.

Polyanhydrides are another type of particularly suitable degradable polymer. Examples of suitable polyanhydrides include poly(adipic anhydride), poly(suberic anhydride), poly(sebacic anhydride), and poly(dodecanedioic anhydride). Other suitable examples include, but are not limited to, poly(maleic anhydride) and poly(benzoic anhydride).

Figure 4:
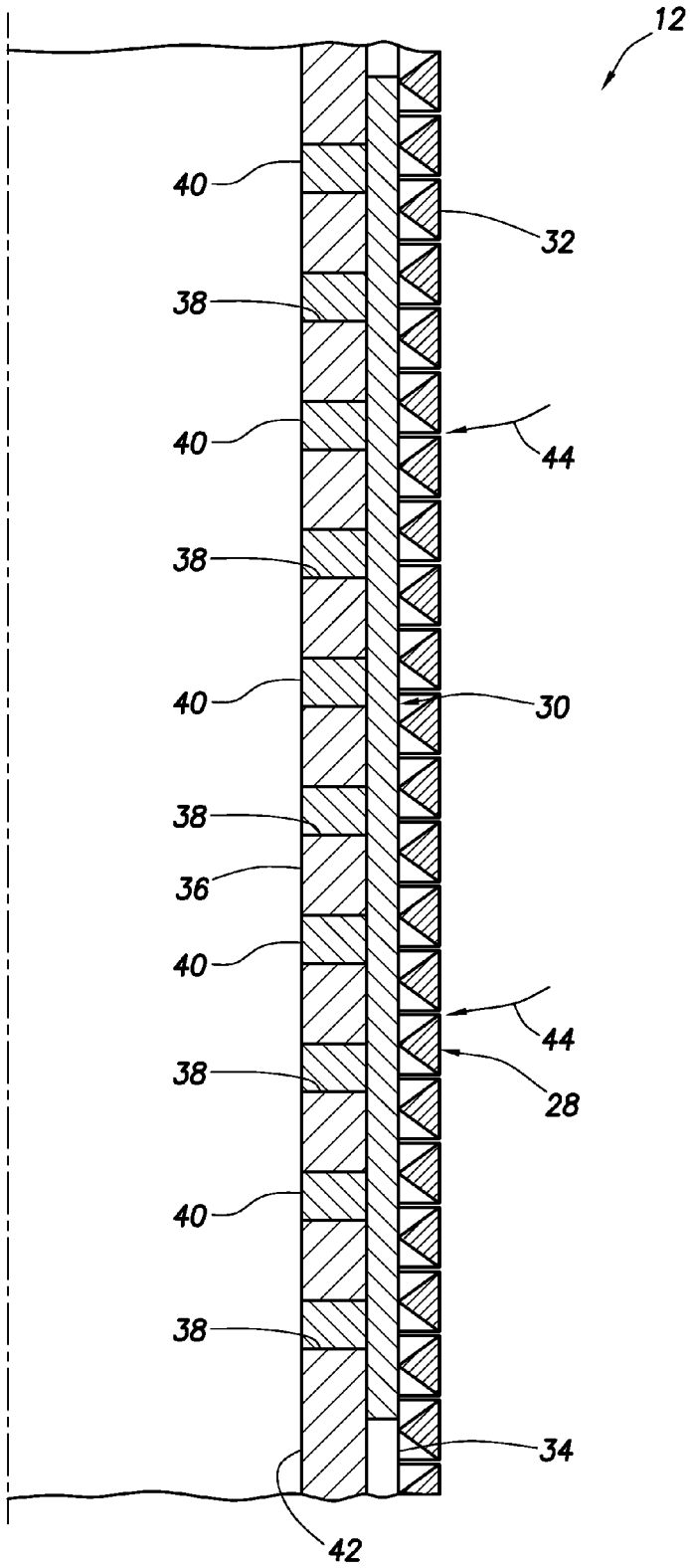
FIG. 4 is a schematic cross-sectional view of yet another configuration of the well screen assembly.

Referring additionally now to FIG. 4, another configuration of the well screen assembly 12 is representatively illustrated. In this configuration, the acid containing structure 30 is external to the base pipe 36, but is still in close proximity to the plugs 40.

As depicted in FIG. 4, the structure 30 is positioned in the drainage layer 34 of the well screen 28. However, in other examples, the structure 30 could be positioned in the filter portion 32, in an outer shroud (not shown), or in any other portion of the well screen 28.

Note that the aqueous fluid 44 contacts the structure 30 from an exterior of the well screen 28 in the example of FIG. 4. The structure 30 in this configuration could be similar to that described above for the FIG. 2 configuration (in which the structure is made of an acidic material, such as polylactic acid, etc.), or similar to that described above for the FIG. 3 configuration (in which the structure comprises a dissolvable container having an acid therein).

It may now be fully appreciated that this disclosure provides significant advancements to the art of selectively controlling flow through a well screen in a well. In each of the examples described above, there is no need to circulate acid to the well screen 28 in order to dissolve plugs 40 therein. Instead, an acid containing structure 30 is present in the well screen assembly 12 when it is installed in the wellbore 16.

The above disclosure provides to the art a method of selectively controlling flow through a well screen 28. The method can include installing the well screen 28 in a wellbore 16, and then exposing the well screen 28 to an aqueous fluid 44, thereby permitting flow through the well screen 28.

Exposing the well screen 28 to the aqueous fluid 44 can include: a) contacting an acid containing structure 30 with the aqueous fluid 44, b) dissolving at least a portion of an acid containing structure 30, c) releasing an acid 48 from a structure 30 containing the acid 48, d) contacting a polylactic acid structure 30 with the aqueous fluid 44, e) dissolving a polylactic acid structure 30, and/or f) dissolving at least one plug 40 which blocks flow through the well screen 28.

Installing the well screen 28 in the wellbore 16 may include installing an acid containing structure 30 in the wellbore 16 with the well screen 28. The acid containing structure 30 may be at least partially dissolvable in response to contact with the aqueous fluid 44.

Installing the acid containing structure 30 in the wellbore 16 can include positioning the acid containing structure 30 within an interior longitudinal flow passage 42 of the well screen 28, positioning the acid containing structure 30 external to a base pipe 36 of the well screen 28, and/or positioning the acid containing structure 30 proximate at least one plug 40 which blocks flow through the well screen 28.

Also provided by the above disclosure is a well screen assembly 12 for use in a subterranean well. The well screen assembly 12 can include a well screen 28 and an acid containing structure 30 which dissolves in response to contact with an aqueous fluid 44, whereby flow through the well screen 28 is selectively permitted.

The acid containing structure 30 may comprise polylactic acid. The polylactic acid may form a container 46 which contains another acid 48.

At least one plug 40 may prevent flow through the well screen 28. The plug 40 preferably dissolves in response to contact with acid released from the acid containing structure 30.

The acid containing structure 30 may be positioned within an interior longitudinal flow passage 42 of the well screen 28, external to a base pipe 36 of the well screen 28, and/or proximate at least one plug 40 which blocks flow through the well screen 28. The acid containing structure 30 may be attached to a base pipe 36 of the well screen 28.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

In the above description of the representative examples of the disclosure, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A method of selectively controlling flow through a well screen, the method comprising:

installing at least one plug in the well screen, the plug preventing fluid flow through an opening in the well screen;

then installing the well screen and an acid containing structure in the wellbore; and then exposing the acid containing structure to an aqueous fluid, thereby releasing acid which dissolves the plug, whereby flow through the opening is selectively permitted.

2. The method of claim 1, wherein the acid containing structure is at least partially dissolvable in response to contact with the aqueous fluid.

3. The method of claim 1, wherein installing the acid containing structure in the wellbore further comprises positioning the acid containing structure within an interior longitudinal flow passage of the well screen.

4. The method of claim 1, wherein installing the acid containing structure in the wellbore further comprises positioning the acid containing structure external to a base pipe of the well screen.

5. The method of claim 1, wherein installing the acid containing structure in the wellbore further comprises positioning the acid containing structure proximate the plug.

6. The method of claim 1, wherein exposing the acid containing structure to the aqueous fluid further comprises contacting a polylactic acid structure with the aqueous fluid.

7. The method of claim 6, wherein contacting the polylactic acid structure with the aqueous fluid further comprises dissolving the polylactic acid structure.

8. The method of claim 6, wherein the polylactic acid structure comprises a container which contains another acid.

9. A well screen assembly for use in a subterranean well, the well screen assembly comprising:

a well screen;

at least one plug which prevents fluid flow through an opening in the well screen prior to installation of the well screen in the well; and an acid containing structure which dissolves in response to contact with an aqueous fluid and thereby releases acid which dissolves the plug, whereby flow through the opening is selectively permitted.

10. The well screen assembly of claim 9, wherein the acid containing structure comprises polylactic acid.

11. The well screen assembly of claim 10, wherein the polylactic acid forms a container which contains another acid.

12. The well screen assembly of claim 9, wherein the acid containing structure is positioned within an interior longitudinal flow passage of the well screen.

13. The well screen assembly of claim 9, wherein the acid containing structure is positioned external to a base pipe of the well screen.

14. The well screen assembly of claim 9, wherein the acid containing structure is positioned proximate the plug.

15. The well screen assembly of claim 9, wherein the acid containing structure is attached to a base pipe of the well screen.

* * * * *